US006230952B1

(12) United States Patent
Jupiter

(10) Patent No.: US 6,230,952 B1
(45) Date of Patent: May 15, 2001

(54) SUNDRY POUCH FOR BACKPACKS

(76) Inventor: Jay Arthur Jupiter, 8208 Orville St., Alexandria, VA (US) 22309

( * ) Notice: Subject to any disclaimer, the term of this patent is extended or adjusted under 35 U.S.C. 154(b) by 0 days.

(21) Appl. No.: 09/418,707

(22) Filed: Oct. 15, 1999

(51) Int. Cl.[7] ..... A45F 3/04

(52) U.S. Cl. ..... 224/655; 150/113; 150/114; 224/153; 224/653

(58) Field of Search ..... 224/655, 153, 224/652, 653, 603, 582, 583, 144.5; 150/113, 114; 190/108, 109, 110

(56) References Cited

U.S. PATENT DOCUMENTS

| | | | | |
|---|---|---|---|---|
| 2,937,728 | * | 5/1960 | Koffler | 190/110 |
| 4,085,873 | | 4/1978 | Schweitzer . | |
| 4,087,102 | | 5/1978 | Sprague . | |
| 4,192,365 | | 3/1980 | Siegel . | |
| 4,386,642 | * | 6/1983 | Durbin | 190/110 X |
| 4,506,769 | * | 3/1985 | Franco et al. | 190/110 X |
| 4,566,130 | | 1/1986 | Coates . | |
| 4,609,084 | * | 9/1986 | Thomas | 190/110 |
| 4,756,394 | | 7/1988 | Cohen . | |
| 4,967,986 | | 11/1990 | Schildkraut . | |
| 5,044,537 | | 9/1991 | Bufalo . | |
| 5,048,975 | | 9/1991 | Holbrook . | |
| 5,062,557 | | 11/1991 | Mahvi . | |
| 5,152,612 | | 10/1992 | Shoemaker . | |
| 5,234,143 | | 8/1993 | Mahvi . | |
| 5,240,106 | | 8/1993 | Plath . | |
| 5,287,571 | | 2/1994 | Rademacher . | |
| 5,402,869 | | 4/1995 | Salzman . | |
| 5,447,215 | * | 9/1995 | Volkmar et al. | 190/110 X |
| 5,509,279 | | 4/1996 | Brown . | |
| 5,630,537 | | 5/1997 | Sciacca . | |
| 5,743,447 | | 4/1998 | McDermott . | |
| 5,881,850 | * | 3/1999 | Murdoch | 190/110 |
| 6,000,509 | * | 12/1999 | Chisholm | 190/110 X |

* cited by examiner

*Primary Examiner*—Gregory M. Vidovich
*Assistant Examiner*—Maerena W. Brevard
(74) *Attorney, Agent, or Firm*—Alfred M. Walker

(57) ABSTRACT

A sundry pouch for backpacks is a compartment covered by a flap of the backpack. The sundry pouch attaches to the flap of the backpack, and includes pockets and sections to hold toothpaste, toothbrush, soap, mirror, first aid supplies and other sundry items. The pouch preferably has a flap to keep these sundry items in place when the backpack's flap is closed and the sundry items are held upside down in a storage position, but in an upright exposed position when the flap is lowered down from the backpack. The sundry pouch is removably attachable to the backpack flap, so that it can be removed and carried to a washing area of a remote campsite. The sundry pouch organizes the sundry items for efficient, quick, and reliable access. The sundry pouch is small and slim in a closed position within the backpack.

10 Claims, 3 Drawing Sheets

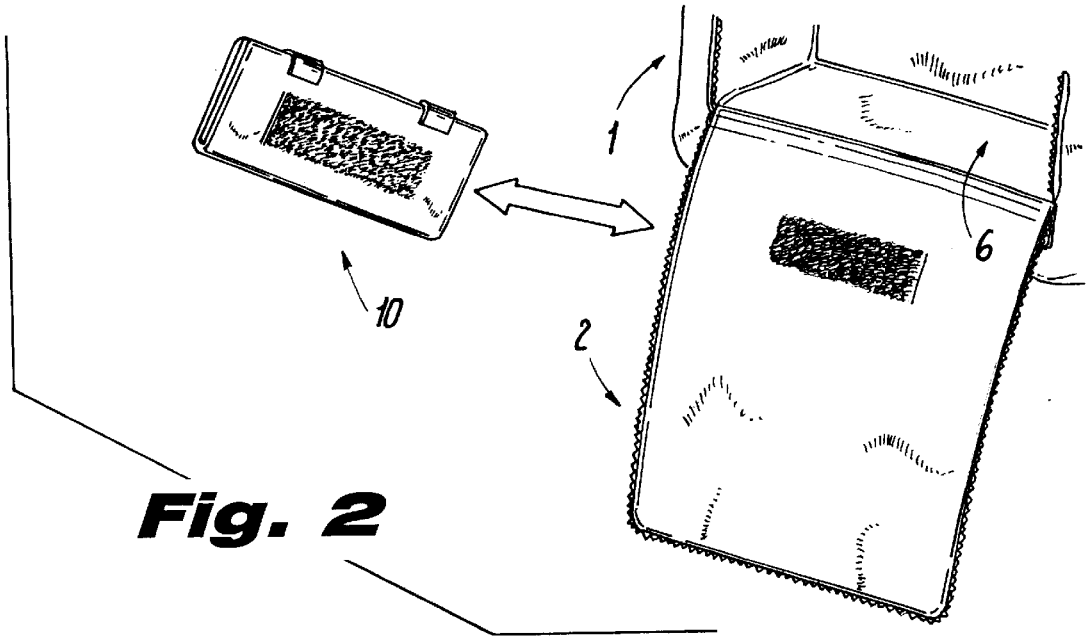
Fig. 2
Fig. 3
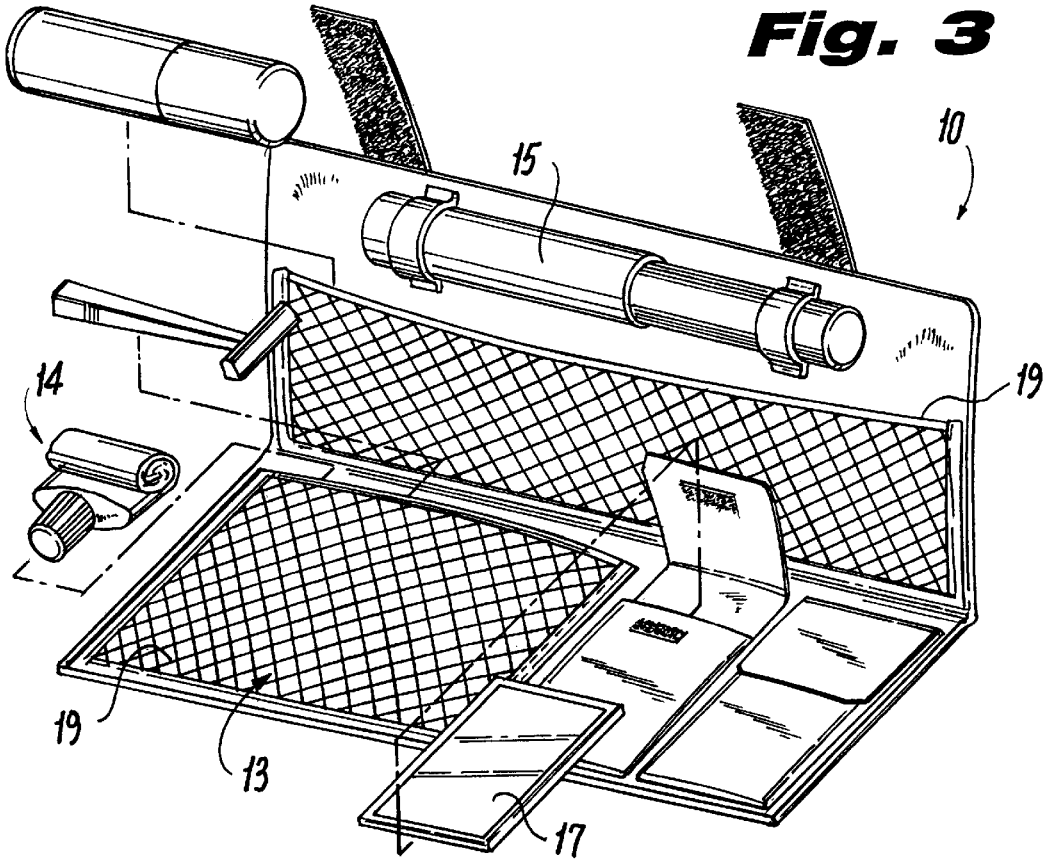

1
6
15
14
18
2
19
11
10

SUNDRY POUCH FOR BACKPACKS

FIELD OF THE INVENTION

The present invention relates to sundry pouches for backpacks.

BACKGROUND OF THE INVENTION

Most backpacks, especially those for overnight backpacking, contain a compartment covered by a flap which zips on three sides so that the flap comes down. Furthermore, most campers require a supply of sundry items and other personal items such as toothpaste, toothbrush, soap, mirror and other sundry items. However, most backpacks do not contain a separate compartment for storing sundry items in an organized, easily accessible manner, to keep these sundry items in place. Furthermore, backpacks do not have a detachable compartment for taking sundry items out of the backpack, such as to a washroom lavatory. Without such a removable pouch for organizing sundry items, the storage of multiple sundry items may interfere substantially with other articles packed into the pack compartment or may be difficult to access or even find.

Various prior art patents include U.S. Pat. No. 5,743,447 of McDermott discloses a backpack 1 with a removable pouch 25. However, VELCRO® fasteners attach the pouch 25 to the exterior of the backpack. It requires a separate tether 50 to keep it in place upon the backpack 1. Furthermore, there is no description of the pouch 25 having subcompartments for personal sundry items.

U.S. Pat. No. 4,085,873 of Schweitzer describes a backpack with a separate interior pouch 32. The backpack can be turned inside out so that pouch 32 becomes a storage compartment for the backpack therein. However the pouch 32 is not removable from the backpack.

A similar "inside out" arrangement is disclosed for a handbag in U.S. Pat. No. 5,152,612 of Shoemaker. However, there is no removable pouch.

Removable pouches are disclosed in three additional patents, namely, U.S. Pat. No. 4,566,130 of Coates for a foldable diaper bag with a removable, VELCRO® attached water proof pouch 44 for storing soiled diapers therein, U.S. Pat. No. 4,192,365 of Siegel for an organizer handbag with subcompartments, including removable pouch 130 and U.S. Pat. No. 5,402,869 of Saltzman for an infant diaper bag 12 with a detachable minibag 14.

U.S. Pat. No. 5,287,571 of Rademacher disclosed a sleeping bag 10 which has at its head portion a removable sundry pouch 19. The pouch 19 is specifically designated for personal items such as a toothbrush, hair comb, etc. See column 2 lines 35–44 of the text. It includes VELCRO® fasteners 20. It doesn't address having subcompartments within pouch 19.

U.S. Pat. No. 5,240,106 of Plath discloses a camera carry bag with removable compartments.

Other travel bags, some with removable compartments, are noted in U.S. Pat. No. 5,234,143 of Mahvi, 5,062,557 also of Mahvi, 4,756,394 of Cohen and 4,087,102 of Sprague.

U.S. Pat. No. 5,048,975 of Holbrook discloses a blanket that folds to a carry bag and U.S. Pat. No. 4,967,986 of Schildkraut discloses a portable sundry pouch with subcompartments for personal care items, such as audio cassettes, money, keys, and suntan lotion.

Other backpacks with removable pouches include U.S. Pat. No. 5,509,279 of Brown for a cooler back pack with a removable ice container 10 and food container 20.

U.S. Pat. No. 5,044,537 of Bufalo describes a backpack with a removable, compartmentalized organizer container. However, there is no provision for the organizer container to be attached to a backpack flap and it contains little, rigid slidable drawers.

Additionally, U.S. Pat. No. 5,630,537 of Sciacca discloses a compartmentalized knapsack with removable drawers pans. However, it does not disclose a single pouch with subcompartments for sundry items, wherein the pouch is removably attached to a flap of the backpack, so that it is peripherally accessible to the user, without having to rummage through the interior contents of the backpack.

OBJECTS OF THE INVENTION

It is therefore an object of the present invention to provide a removable sundry pouch which has pockets and sections to hold toothpaste, toothbrush, soap, mirror, first aid supplies and other sundry items for a backpack which is an attachment to the closing flap of a compartment of any backpack.

It is also an object of the present invention to provide a pouch which also has a retaining flap to keep these sundry items in place when the backpack's flap is closed on the sundry items as they are held upside down.

It is also an object of the present invention to provide a pouch which also has a elastic or netting to keep these sundry items in place when the backpack's flap is closed on the sundry items as they are held upside down.

It is yet another object of the present invention to provide a removable backpack pouch which can be removably attached to the backpack closing flap without destroying the integrity of the flap.

It is yet another object of the present invention to easily organize sundry items for efficient, quick, and reliable access from any backpack.

It is also an object of the present invention to provide a removable pouch for a backpack which is small and slim enough so as not to interfere substantially with other articles packed into the pack compartment.

It is yet another object of the present invention to improve over the disadvantages of the prior art.

SUMMARY OF THE INVENTION

The product can be characterized as a "sundry pouch" for backpacks.

Most backpacks, especially those for overnight backpacking, contain a compartment covered by a flap which zips on three sides so that the flap comes down.

The sundry pouch is attached by an attachment fastener to the flap which has pockets and sections to hold toothpaste, toothbrush, soap, mirror, first aid supplies, and other sundry items.

The sundry pouch also has a flap with a closure fastener to keep these sundry items in place when the backpack's flap is closed and the sundry items are held upside down. The sundry pouch is attached to the flap by tape, clips, snaps or even stitching. This attaching may be somewhat delicate so as not to destroy the integrity of the flap.

This article addresses the need of backpack users to easily organize the included sundry items for efficient, quick, and reliable access. The nature of the sundry pouch is that it is small and slim enough so as not to interfere substantially with other articles packed into the pack compartment.

The uniqueness of the present invention encompasses the design elements of flatness, easy accessibility of the sundry pouch upon a flap of a backpack and easy removable adherence thereon, with removal function being independent of the pack. It has the ability to obtain a separate personal accessory to the pack makes it affordable and its portable versatility makes it useable with a variety of backpacks, unlike the uncompartmentalized exterior pouch attached by a tether to the backpack of McDermott '447, which is bulky and not securely attached to the inside of a backpack. In fact, the exterior mounted pouch of McDermott requires an extra tether, just to keep the pouch from being accidentally or intentionally dislodged from its exposed position on the exterior of the backpack. In contrast, the present invention emphasizes unobtrusiveness and accessibility in a secure but readily accessible position inside the backpack.

Unlike the separable hand carried sundry pouch of Schildkraut '986, which can only be randomly inserted into the backpack, behind a multitude of other items, thuds making the Schildkraut '986 sundry pouch inaccessible and requiring a user to have to unload most larger items of a backpack, such as clothes, cooking supplies, tools etc. In contrast, the sundry pouch of the present invention is easily accessible and removable from a first openable flap of the backpack, without the need to rummage through all of the items stored within the backpack.

Unlike the sundry pouch of Rademacher '571, which is a pouch removably attached to the inside head portion of a sleeping bag, and which is only accessible when the entire sleeping bag is unfurled, the present invention is easily accessible and removable from a first openable flap of the backpack, without the need to rummage through all of the items stored within the backpack.

The first openable flap need only occupy a small portion of the rear surface of the backpack, depending upon the dimensions of the sundry pouch attached to the first openable flap.

The accessibility, removability and compactness of the sundry pouch has never been appreciated previously, and therefore is not suggested by any combination of the prior art. For example, one cannot put the exterior mounted pouch of McDermott '447 inside of McDermott '447's backpack, because it is bulky and takes up too much space, and the McDermott '447 backpack does not have a special openable flap for removably attaching a thin, sundry pouch therein. Nor can one attach the sundry pouch of the present invention to Rademacher '571's sleeping bag, because the sleeping bag must be unfurled first, and it does not contain an auxiliary openable flap that would obviate the need to open the sleeping bag, and is therefore not easily accessible and does not need to be separately carried, like the bulky sundry pouch of Schildkraut '986, with has an exterior handle, which pouch can be inserted within a backpack, but only randomly within all the other contents of the backpack.

Therefore, the present invention solves a long felt need for backpackers to gain quick access to personal sundry items within a securely stored sundry pouch, without having to fully open a backpack and rummage through its contents.

DESCRIPTION OF THE DRAWINGS

The present invention can best be understood in conjunction with the accompanying drawings, in which:

FIG. 2 is an exploded perspective view of the sundry pouch in combination with a backpack of the present invention, shown in the closed position, and shown attachable to the interior surface of the flap of a backpack;

FIG. 3 is an exploded, close-up perspective view of the sundry pouch for backpacks of the present invention, shown in the open content storage position;

DETAILED DESCRIPTION OF THE PREFERRED EMBODIMENT

Figure 1:
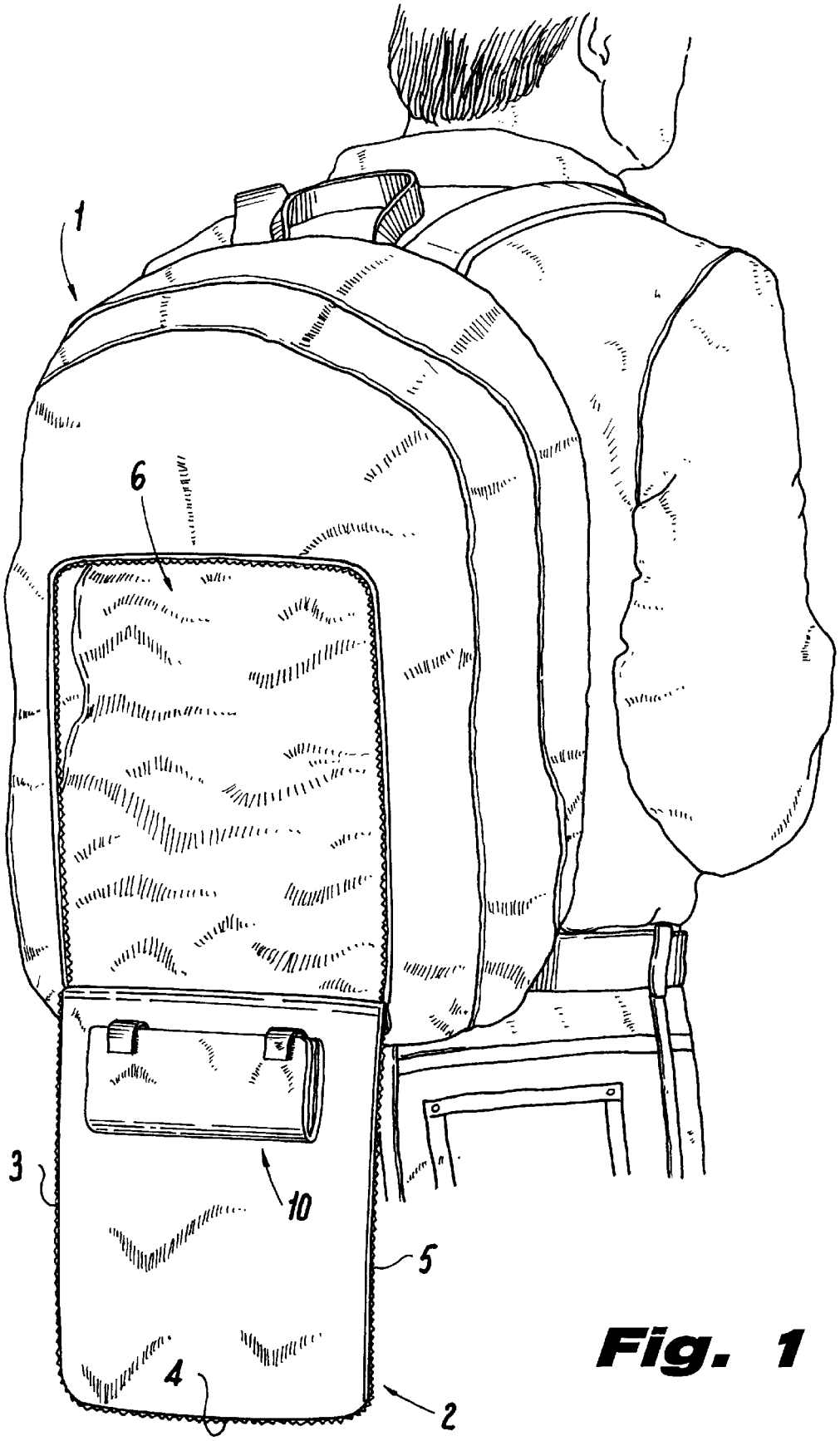
FIG. 1 is a perspective view of the sundry pouch in combination with a backpack of the present invention, shown in the closed content storage position upon a backpack flap.

FIGS. 1 and show sundry pouch 10 for backpack 1, shown in the closed content storage position upon an inside surface of flap 2 of backpack 1, wherein backpack 1 has at least one hollow interior portion 6.

Sundry pouch 10 is made of preferably a waterproof, flexible material, such as canvas or other backpack polymer fabric. Moreover, sundry pouch 10 is a removable attachment to flap 2 of backpack 1.

FIG. 1 further shows backpack 1, especially for overnight backpacking, containing a hollow interior portion 6 covered by a closing flap 2, which closing flap 2 closes on three sides 3, 4, 5, by a closure member such as by zippers, for example or other closures, along at least one edge of said flap 2. Upon opening of said closure members for sides 3, 4 and 5, flap 2 comes down to expose an open interior portion 6 of backpack 1.

FIG. 2 shows that sundry pouch 10 is preferably attached to closing flap 2 by a fastener means, such as by VELCRO® hook and loop fasteners. Other fastening means (not shown) may include tape, clips, snaps or even temporary stitching which does not destroy the integrity of closing flap 2.

Figure 4:
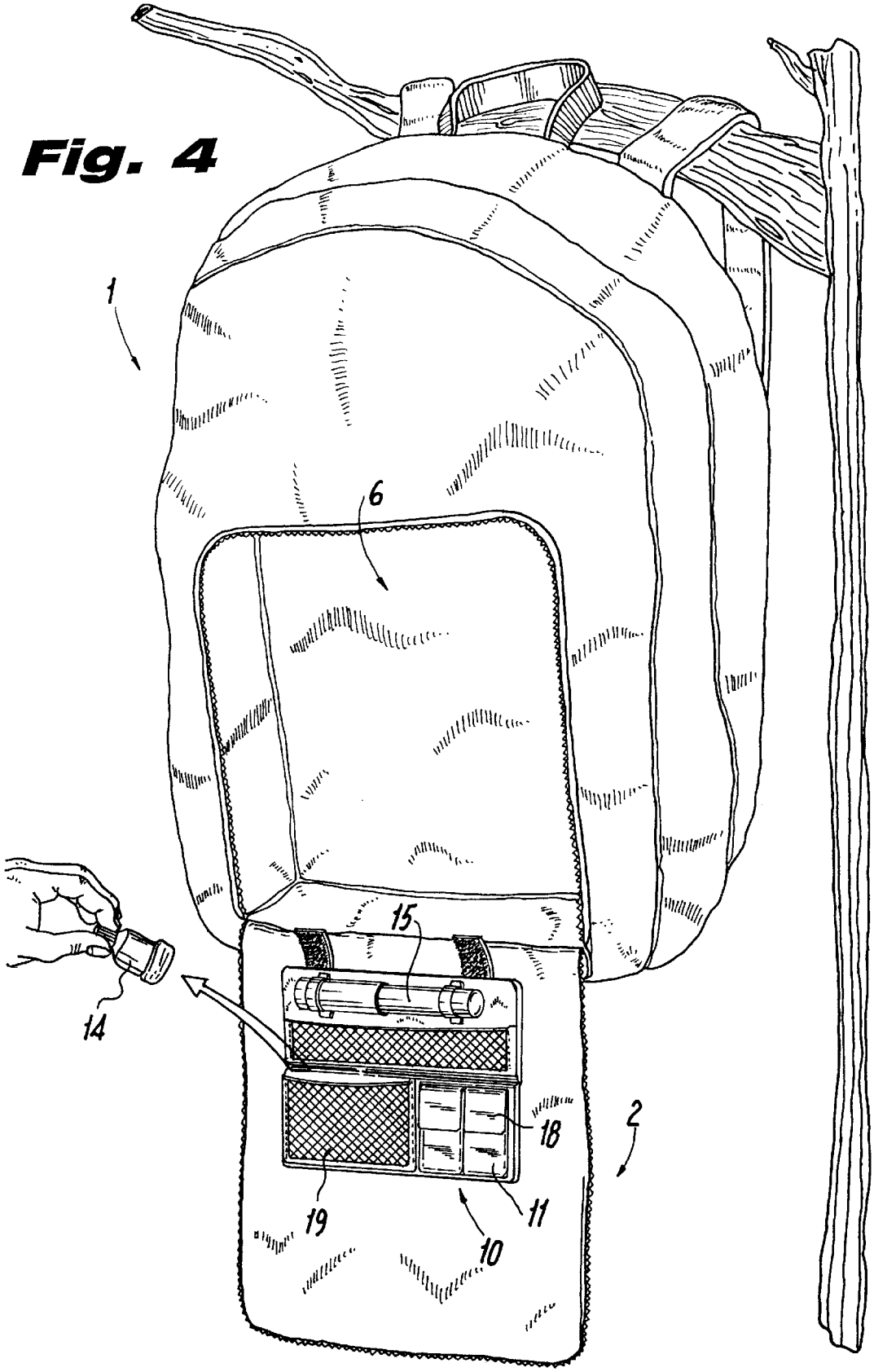
FIG. 4 is a perspective view of the sundry pouch in combination with a backpack of the present invention, shown in an open access position upon a backpack flap, wherein the backpack is supported upon a tree branch.

FIGS. 3 and 4 show sundry pouch 10 for backpack 1 in the open content access position.

FIGS. 3 and 4 further show sundry pouch 10 including at least one sundry retaining sub-compartment 11 therein, such as pockets 12 and sections 13, to hold personal sundry items, such as, for example, toothpaste tube 14, toothbrush container 15, shaving cream dispenser 16, mirror 17 and other sundry items, such as soap bars, etc. (not shown).

Sundry pouch 10 preferably includes retaining flap 18 to keep these sundry items 14, 15, 16, 17 in place. Flap 18 is held in place by at least one closure retaining member, such as tabs 20, which may be VELCRO® hook and loop fastener tabs, or other tabs (not shown), closed by snaps, buttons, etc.

When closing flap 2 of backpack 1 is closed over sundry pouch 10 containing sundry items 14, 15, 16, 17 etc. therein, these items 14, 15, 16, 17 are held upside down in the closed storage position, so that when retaining flap 18 is opened, sundry items 14, 15, 16, 17 are exposed-right side up for easy access from pouch 10.

While pockets 12 are closed by conventional cover flaps, to keep the sundry items in place within the respective open sub-compartments 11 or open sections 13 etc., preferably a further holding means 19, such as an elastic netting or strap (not shown) is stretched across each open sub-compartment 11 or section 13 etc. to hold sundry items 14, 15, 16, 17 etc. in place, without slipping out.

While the drawing FIGS. 3 and 4 show a variety of container portions, such as open sub-compartments 11, pockets 12 or open sections 13 for sundry items 14, 15, 16, 17 etc., it is contemplated that pouch 10 may have any number or combination of these types of container portions, such as a single container portion or a plurality of container portions, depending upon the number and configuration of sundry items 14, 15, 16, 17 etc. sought to be carried within sundry pouch 10.

Sundry pouch 10 addresses the need of backpack users to easily organize the included sundry items 14, 15, 16, 17 etc. for efficient, quick, and reliable access therefrom.

Sundry pouch 10 is small and slim enough so as not to be bulky and to interfere substantially with other articles packed into the hollow backpack interior portion 6 of backpack 1.

For example, while size and proportion may vary, it is contemplated that a preferable embodiment has a depth which is very shallow, such as for example, of about one and ½ inches or less, preferably one inch or less, when compared to the height and width of sundry pouch 10, which is typically 3 to 4 inches in height and 6 to 8 inches in width.

This shallow slimness of sundry pouch 10 need only be as deep as the sundry items 14, 15, 16 or 17, etc. carried therein.

For example, a typical toothpaste tube, such as toothpaste tube 14 is less than one inch in diameter, even when filled and unrolled, and when rolled as depicted in FIG. 3, it is even smaller.

A typical travel size shaving cream dispenser, such as shaving cream dispenser 16 is about an inch in diameter. Other sundry items such as toothbrush 15 or mirror 17 are even smaller.

It is further noted that other modifications may be made to the present invention, without departing from the scope of the invention, as noted in the appended claims.

I claim:

1. A sundry pouch in combination with a backpack comprising:

said backpack having walls forming a fully enclosed hollow interior portion with shoulder straps extending from one side;

one of said walls having a substantially rectangular opening, said opening covered by a closing flap having one edge attached to said wall and pivoted along said edge of said flap between an open position with said flap hanging downwardly from said wall with an interior surface of said flap facing outwardly an a closed position covering said opening;

means for releasably attaching remaining edges of said flap to said wall when said flap is in the closed position;

a sundry pouch comprising a substantially flat member foldable along middle thereof so that when said member is folded a receptacle is formed between portions of said member coming together, said receptacle containing sundry items;

means for releasably attaching said sundry pouch to said interior surface of said flap comprising mating constituents on an outer surface of said sundry pouch when said pouch portions are folded and on said interior surface of said flap whereby when said flap is open extending downwardly with said pouch attached to said flap and said portions of said pouch spread apart with one portion of said pouch unfolded down exposing said sundry items within said pouch for convenient access;

said sundry pouch having a closure fastener for securing said pouch portions in a folded position enclosing the sundry items therein in a secure storage position; and, said sundry pouch having a container portion therein, to hold sundry items including toothpaste, toothbrush, soap, and a mirror.

2. The sundry pouch in combination with a backpack as in claim 1 wherein said sundry pouch is made of a waterproof material.

3. The sundry pouch in combination with a backpack as in claim 2 wherein said sundry pouch is made of a flexible material.

4. The sundry pouch in combination with a backpack as in claim 3 wherein said sundry pouch is made of canvas.

5. The sundry pouch in combination with a backpack as in claim 3 wherein said sundry pouch is made of a polymer fabric.

6. The sundry pouch in combination with a backpack as in claim 1 wherein mating constituents are hook and loop fasteners.

7. The sundry pouch in combination with a backpack as in claim 1 wherein said mating constituents include double sided tape.

8. The sundry pouch in combination with a backpack as in claim 1 wherein said sundry pouch folds to a substantially slim configuration in a storage position for insertion into said backpack.

9. The sundry pouch in combination with a backpack as in claim 8 wherein said sundry pouch has a depth which is very shallow, when compared to a height and a width of said sundry pouch.

10. The sundry pouch in combination with a backpack as in claim 9 wherein said depth of said sundry is about one ½ inch or less, and wherein said sundry pouch is about 3 to 4 inches in height and about 6 to 8 inches in width.

* * * * *